US006779979B1

(12) United States Patent
Wadia et al.

(10) Patent No.: US 6,779,979 B1
(45) Date of Patent: Aug. 24, 2004

(54) METHODS AND APPARATUS FOR STRUCTURALLY SUPPORTING AIRFOIL TIPS

(75) Inventors: Aspi R. Wadia, Loveland, OH (US); Rolf Hetico, Cincinnati, OH (US); Robert Bruce Dickman, Cincinnati, OH (US); Hsin-Yi Yen, Mason, OH (US); Peter Wood, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/421,286

(22) Filed: Apr. 23, 2003

(51) Int. Cl.[7] ..... F01D 5/10
(52) U.S. Cl. ..... 416/236 R; 416/500
(58) Field of Search ..... 415/119; 416/194, 416/195, 190, 235, 236 R, 500

(56) References Cited

U.S. PATENT DOCUMENTS 3,012,709 A * 12/1961 Schnell ..... 416/236 R
4,108,573 A * 8/1978 Wagner ..... 416/236 A
4,589,824 A 5/1986 Kozlin
4,919,593 A * 4/1990 Brown ..... 416/223 A
5,261,789 A 11/1993 Butts et al.
6,164,914 A 12/2000 Correia et al.
6,179,556 B1 1/2001 Bunker
6,382,913 B1 5/2002 Lee et al.
6,503,053 B2 * 1/2003 Huebner ..... 415/191

* cited by examiner

*Primary Examiner*—Ninh H. Nguyen
(74) *Attorney, Agent, or Firm*—William Scott Andes; Armstrong Teasdale LLP

(57) ABSTRACT

An airfoil for a gas turbine engine includes a leading edge, a trailing edge, a tip, a first side wall that extends in radial span between an airfoil root and the tip, wherein the first side wall defines a first side of said airfoil, and a second side wall connected to the first side wall at the leading edge and the trailing edge, wherein the second side wall extends in radial span between the airfoil root and the tip, such that the second side wall defines a second side of the airfoil. The airfoil also includes a rib that extends outwardly from at least one of the first side wall and the second side wall, such that a natural frequency of chordwise vibration of the airfoil is increased to a frequency that is not present within the gas turbine engine during engine operations.

17 Claims, 4 Drawing Sheets

METHODS AND APPARATUS FOR STRUCTURALLY SUPPORTING AIRFOIL TIPS

BACKGROUND OF THE INVENTION

This application relates generally to gas turbine engine rotor blades and, more particularly, to methods and apparatus for reducing vibrations induced to rotor blades.

Gas turbine engine rotor blades typically include airfoils having leading and trailing edges, a pressure side, and a suction side. The pressure and suction sides connect at the airfoil leading and trailing edges, and span radially between the airfoil root and the tip. An inner flowpath is defined at least partially by the airfoil root, and an outer flowpath is defined at least partially by a stationary casing. For example, at least some known compressors include a plurality of rows of rotor blades that extend radially outwardly from a disk or spool.

Known compressor rotor blades are cantilevered adjacent the inner flowpath such that a root area of each blade is thicker than a tip area of the blades. More specifically, because the tip areas are thinner than the root areas, and because the tip areas are generally mechanically unrestrained, during operation wake pressure distributions may induce chordwise bending modes into the blade through the tip areas. In addition, vibrational energy may also be induced into the blades at a resonant frequency present during engine operation. Continued operation with such chordwise bending modes or vibrations may limit the useful life of the blades.

To facilitate reducing chordwise bending modes, and/or to reduce the effects of a resonant frequency present during engine operations, at least some known vanes are fabricated with thicker tip areas. However, increasing the blade thickness may adversely affect aerodynamic performance and/or induce additional radial loading into the rotor assembly. Accordingly, other known blades are fabricated with a shorter chordwise length in comparison to other known blades. However, reducing the chord length of the blade may also adversely affect aerodynamic performance of the blades.

BRIEF SUMMARY OF THE INVENTION

In one aspect a method for fabricating a rotor blade for a gas turbine engine is provided. The method comprises forming an airfoil including a first side wall and a second side wall that each extend in radial span between an airfoil root and an airfoil tip, and wherein the first and second side walls are connected at a leading edge and at a trailing edge, and forming a rib that extends outwardly from at least one of the airfoil first side wall and the airfoil second side wall, extending outwardly from at least one of said first side wall and said second side wall, such that a natural frequency of chordwise vibration of the airfoil is increased to a frequency that is not excited by any excitation frequencies during normal engine operations.

In another aspect, an airfoil for a gas turbine engine is provided. The airfoil includes a leading edge, a trailing edge, a tip, a first side wall that extends in radial span between an airfoil root and the tip, wherein the first side wall defines a first side of said airfoil, and a second side wall connected to the first side wall at the leading edge and the trailing edge, wherein the second side wall extends in radial span between the airfoil root and the tip, such that the second side wall defines a second side of the airfoil. The airfoil also includes a rib extending outwardly from at least one of said first side wall and said second side wall, such that a natural frequency of chordwise vibration of the airfoil is increased to a frequency that is not excited by any excitation frequencies during normal engine operations.

In a further aspect, a gas turbine engine including a plurality of rotor blades is provided. Each rotor blade includes an airfoil having a leading edge, a trailing edge, a first side wall, a second side wall, and at least one rib. The airfoil first and second side walls are connected axially at the leading and trailing edges, and each side wall extends radially from a blade root to an airfoil tip. The rib extends extends outwardly from at least one of the airfoil first side wall and the airfoil second side wall, such that a such that a natural frequency of chordwise vibration of the airfoil is increased to a frequency that is not excited by any excitation frequencies during normal engine operations.

DETAILED DESCRIPTION OF THE INVENTION

Figure 1:
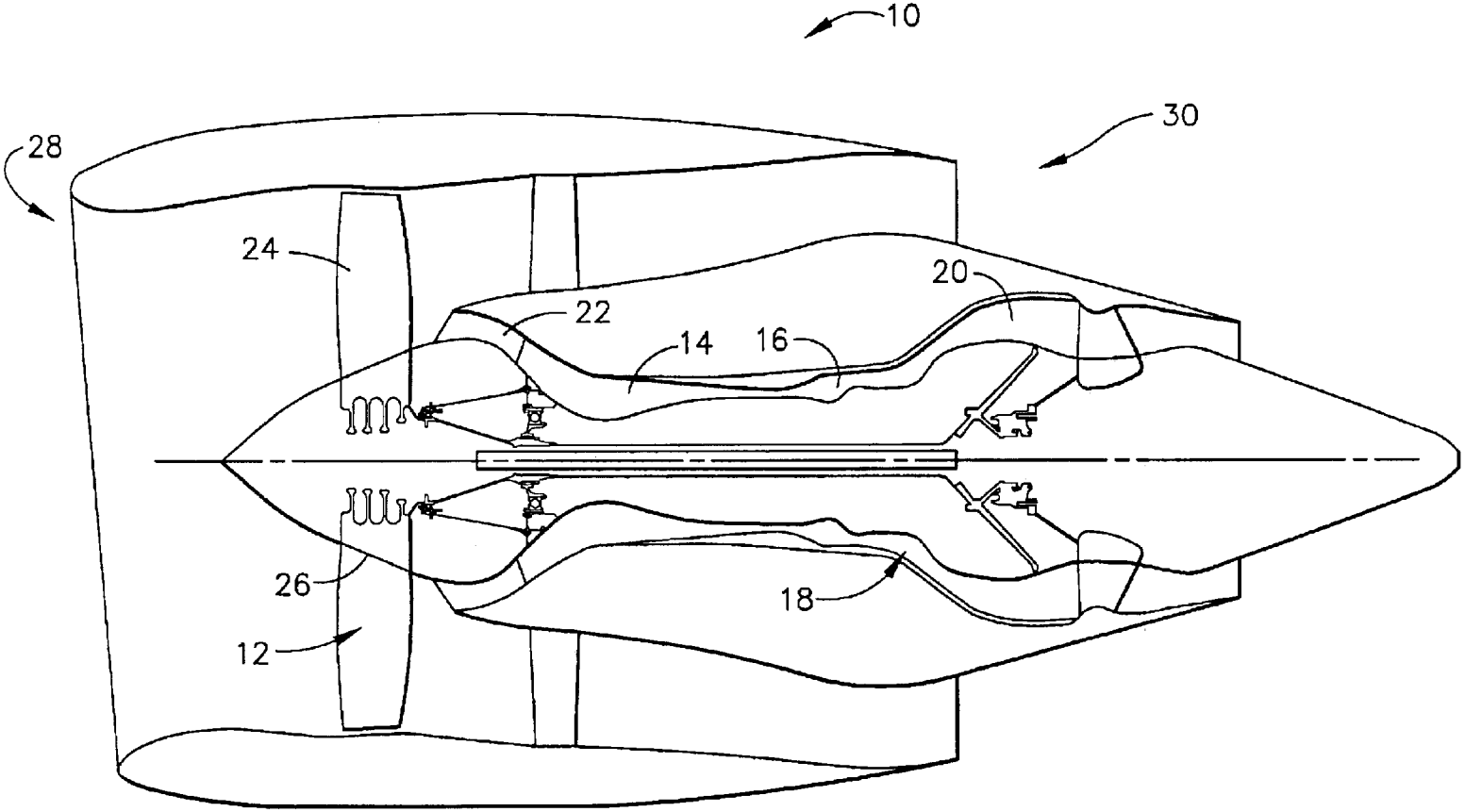
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18, a low pressure turbine 20, and a booster 22. Fan assembly 12 includes an array of fan blades 24 extending radially outward from a rotor disc 26. Engine 10 has an intake side 28 and an exhaust side 30. In one embodiment, the gas turbine engine is a GE90 engine available from General Electric Company, Cincinnati, Ohio.

In operation, air flows through fan assembly 12 and compressed air is supplied to high pressure compressor 14. The highly compressed air is delivered to combustor 16. Airflow (not shown in FIG. 1) from combustor 16 drives turbines 18 and 20, and turbine 20 drives fan assembly 12.

Figure 2:
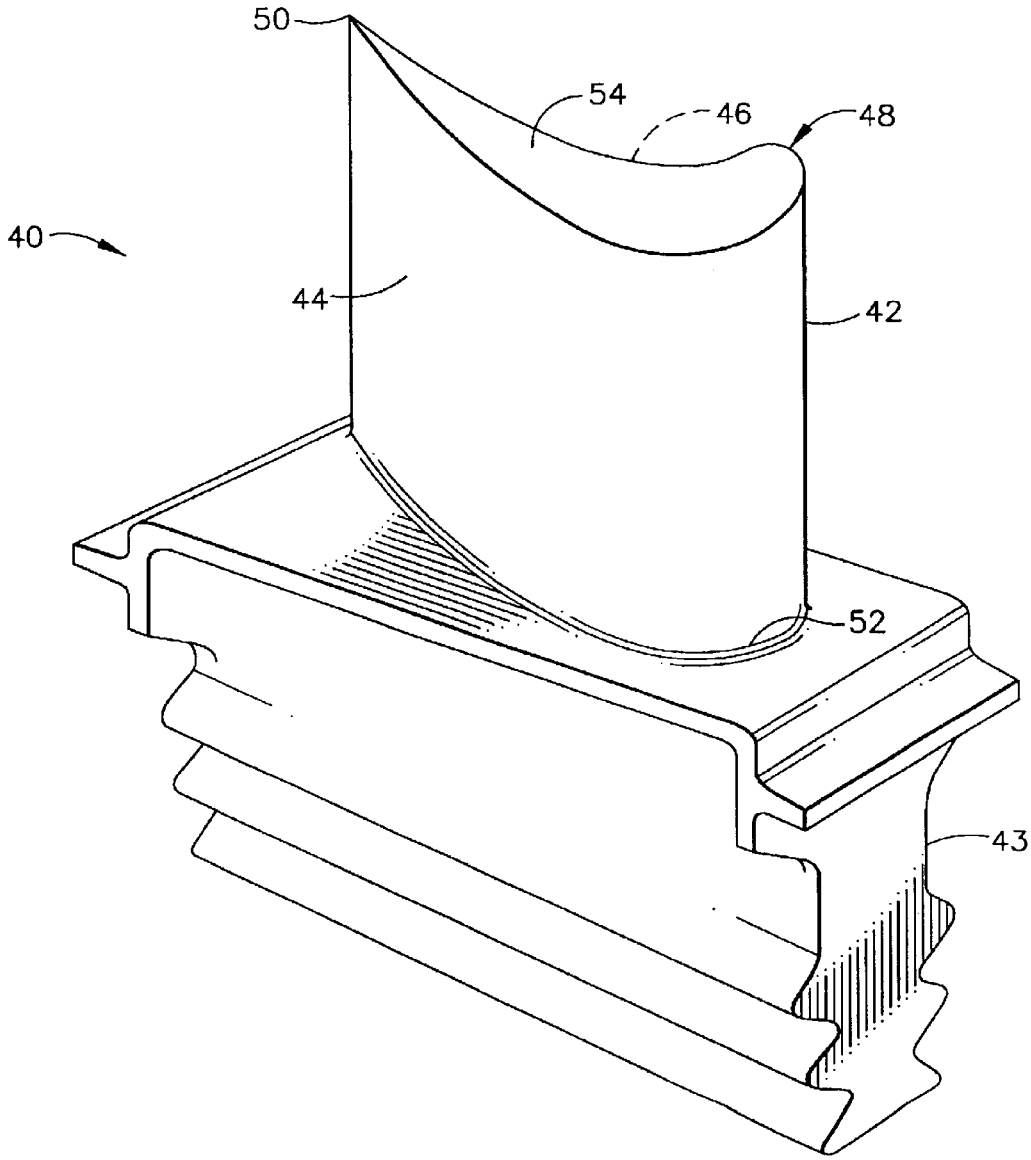
FIG. 2 is a perspective view of a rotor blade that may be used with the gas turbine engine shown in FIG. 1.
Figure 3:
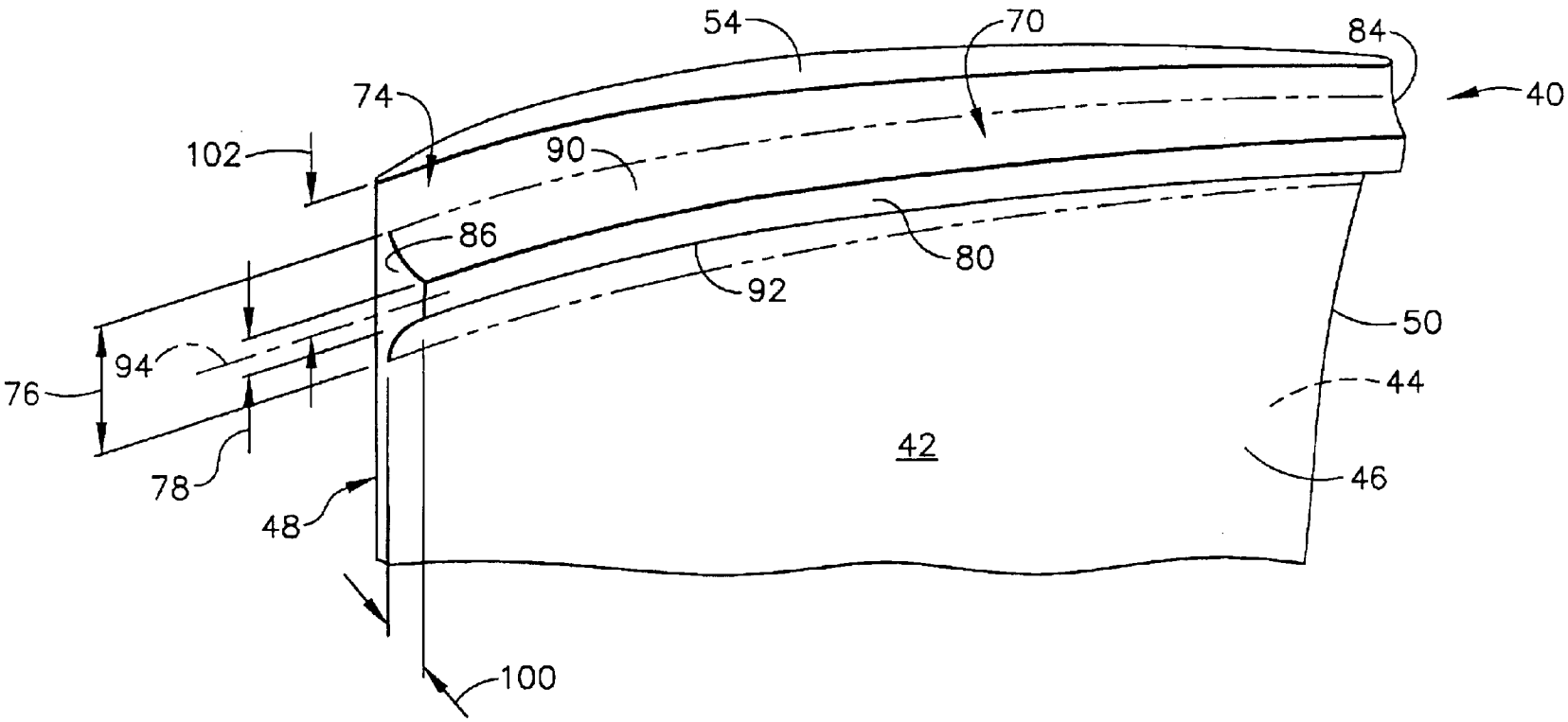
FIG. 3 is an enlarged partial perspective view of the rotor blade shown in FIG. 2, and viewed from an opposite side of the rotor blade.

FIG. 2 is a partial perspective view of a rotor blade 40 that may be used with a gas turbine engine, such as gas turbine engine 10 (shown in FIG. 1). FIG. 3 is an enlarged partial perspective view of the rotor blade shown in FIG. 2, and viewed from an opposite side of rotor blade 40. In one embodiment, a plurality of rotor blades 40 form a high pressure compressor stage (not shown) of gas turbine engine 10. Each rotor blade 40 includes an airfoil 42 and an integral dovetail 43 used for mounting airfoil 42 to a rotor disk (not shown) in a known manner. Alternatively, blades 40 may extend radially outwardly from a disk (not shown), such that a plurality of blades 40 form a blisk (not shown).

Each airfoil 42 includes a first contoured side wall 44 and a second contoured side wall 46. First side wall 44 is convex and defines a suction side of airfoil 42, and second side wall 46 is concave and defines a pressure side of airfoil 42. Side walls 44 and 46 are joined at a leading edge 48 and at an axially-spaced trailing edge 50 of airfoil 42. More specifically, airfoil trailing edge 50 is spaced chordwise and downstream from airfoil leading edge 48. First and second side walls 44 and 46, respectively, extend longitudinally or radially outward in span from a blade root 52 positioned adjacent dovetail 43, to an airfoil tip 54.

A rib 70 extends outwardly from second side wall 46. In an alternative embodiment rib 70 extends outwardly from first side wall 44. In a further alternative embodiment, a first rib 70 extends outwardly from second side wall 46 and a second rib 70 extends outwardly from first side wall 44. Accordingly, rib 70 is contoured to conform to side wall 46 and as such follows airflow streamlines extending across side wall 46. In the exemplary embodiment, rib 70 extends in a chordwise direction across side wall 46. Alternatively, rib 70 is aligned in a non-chordwise direction with respect to side wall 46. More specifically, in the exemplary embodiment, rib 70 extends chordwise between airfoil leading and trailing edges 48 and 50, respectively. Alternatively, rib 70 extends to only one of airfoil leading or trailing edges 48 and 50, respectively. In a further alternative embodiment, rib 70 extends only partially along side wall 46 between airfoil leading and trailing edges 48 and 50, respectively, and does not extend to either leading or trailing edges 48 and 50, respectively.

Rib 70 has a frusto-conical cross-sectional profile such that a root 74 of rib 70 has a radial height 76 that is taller than a radial height 78 of an outer edge 80 of rib 70. In the exemplary embodiment, both height 76 and height 78 are substantially constant along rib 70 between a first edge 84 and a second edge 86. In an alternative embodiment, at least one of root height 74 and outer edge height 78 is variable between rib edges 84 and 86. A geometric configuration of rib 70, including a relative position, size, and length of rib 70 with respect to blade 40, is variably selected based on operating and performance characteristics of blade 40.

Rib 70 also includes a radially outer side wall 90 and a radially inner side wall 92. Radially outer side wall 90 is between airfoil tip 54 and radially inner side wall 92, and radially inner side wall 92 is between radially outer side wall 90 and airfoil root 52. Each rib side wall 90 and 92 is contoured between rib root 74 and rib outer edge 80. In the exemplary embodiment, rib 70 is symmetrical about a plane of symmetry 94, such that rib side walls 90 and 92 are identical. In an alternative embodiment, side walls 90 and 92 are each different and are not identical.

Rib outer edge 80 extends a distance 100 from side wall 46 into the airflow, and rib plane of symmetry 94 is positioned a radial distance 102 from airfoil tip 54 towards airfoil root 52. Distances 100 and 102 are variably selected based on operating and performance characteristics of blade 40.

Rib 70 is fabricated from a material that enables rib 70 to facilitate stiffening airfoil 42. More specifically, rib 70 facilitates stiffening airfoil 42 such that a natural frequency of chordwise vibration of airfoil 42 is increased to a frequency that is not excited by any excitation frequencies during normal engine operations. Accordingly, chordwise bending modes of vibration that may be induced into similar airfoils that do not include rib 70, are facilitated to be substantially eliminated by rib 70. More specifically, rib 70 provides a technique for tuning chordwise mode frequencies out of the normal engine operating speed.

During operation, energy induced to airfoil 42 is calculated as the dot product of the force of the exciting energy and the displacement of airfoil 42. More specifically, during operation, aerodynamic driving forces, i.e., wake pressure distributions, are generally the highest adjacent airfoil tip 54 because tip 54 is generally not mechanically constrained. However, rib 70 stiffens and increases a local thickness of airfoil 42, such that the displacement of airfoil 42 is reduced in comparison to similar airfoils that do not include rib 70. Accordingly, because rib 70 increases a frequency margin of airfoil 42 and reduces an amount of energy that is induced to airfoil 42, airfoil 42 receives less aerodynamic excitation and less harmonic input from wake pressure distributions. In addition, because rib 70 is positioned radial distance 102 from tip 54, rib 70 will not contact the stationary shroud.

Figure 4:
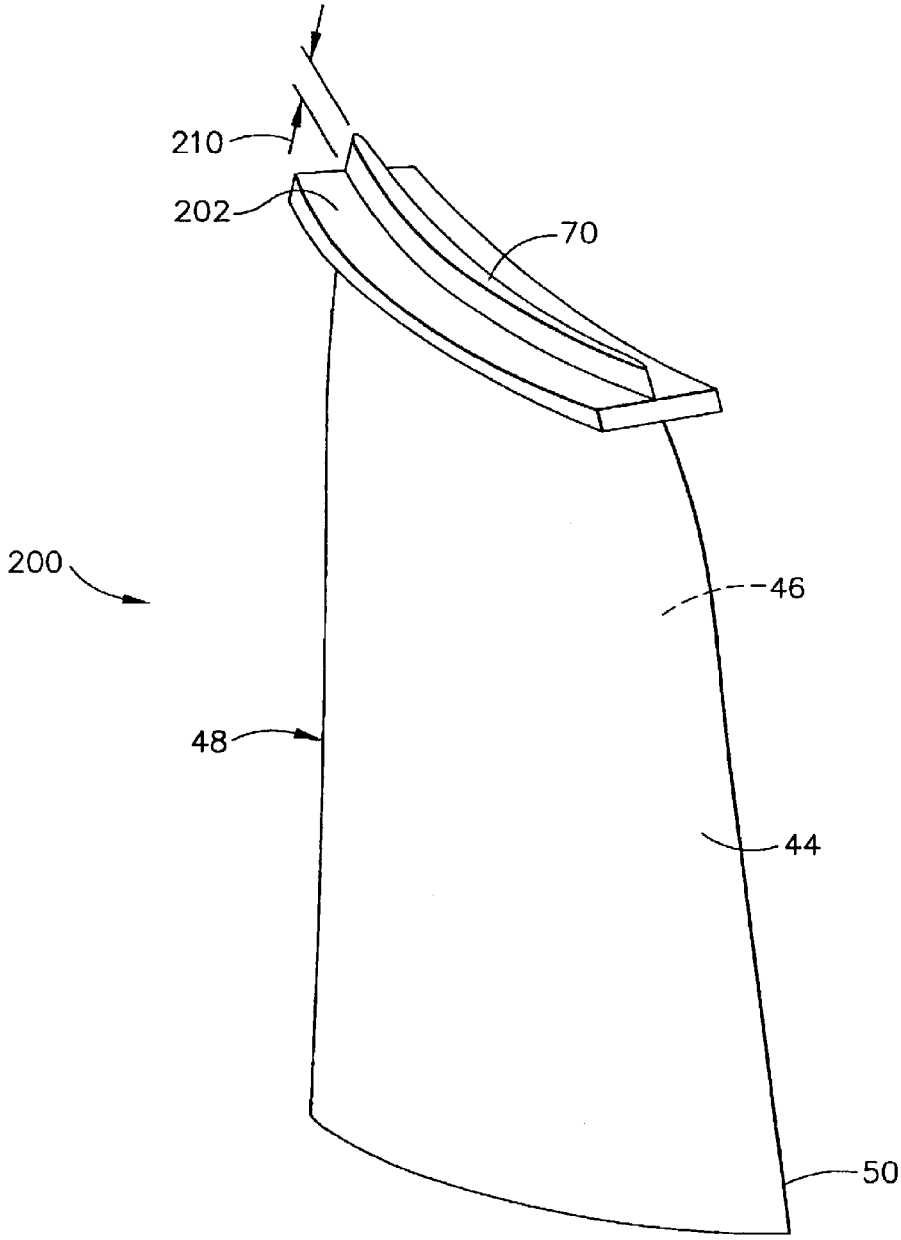
FIG. 4 is a perspective view of an alternative embodiment of a rotor blade that may be used with the gas turbine engine shown in FIG. 1.

FIG. 4 is a perspective view of an alternative embodiment of rotor blade 200 that may be used with the gas turbine engine 10 (shown in FIG. 1). Rotor blade 200 is substantially similar to rotor blade 40 (shown in FIGS. 2 and 3) and components in rotor blade 200 that are identical to components of rotor blade 40 are identified in FIG. 4 using the same reference numerals used in FIGS. 2 and 3. Specifically, in one embodiment, rotor blade 200 is identical to rotor blade 40 with the exception that rotor blade 200 includes a second rib 202 in addition to rib 70. More specifically, in the exemplary embodiment, rib 202 is identical to rib 70 but extends across side wall 44 rather than side wall 46.

Rib 202 extends outwardly from first side wall 44 and is contoured to conform to side wall 44, and as such, follows airflow streamlines extending across side wall 44. In the exemplary embodiment, rib 202 extends in a chordwise direction across side wall 44. Alternatively, rib 202 is aligned in a non-chordwise direction with respect to side wall 44. More specifically, in the exemplary embodiment, rib 202 extends chordwise between airfoil leading and trailing edges 48 and 50, respectively. Alternatively, rib 202 extends to only one of airfoil leading or trailing edges 48 and 50, respectively. In a further alternative embodiment, rib 202 extends only partially along side wall 44 between airfoil leading and trailing edges 48 and 50, respectively, and does not extend to either leading or trailing edges 48 and 50, respectively.

A geometric configuration of rib 202, including a relative position, size, and length of rib 202 with respect to blade 40, is variably selected based on operating and performance characteristics of blade 40. Rib 202 is positioned a radial distance 210 from airfoil tip 54. In the exemplary embodiment, radial distance 210 is approximately equal first rib radial distance 102 (shown in FIG. 3). In an alternative embodiment, radial distance 210 is not equal first rib radial distance 102.

The above-described rotor blade is cost-effective and highly reliable. The rotor blade includes a rib that extends outwardly from at least one of the airfoil side walls. The rib facilitates tuning chordwise mode frequencies out of the normal engine operating speed range. Furthermore, the stiffness of the rib facilitates decreasing an amount of energy induced to each respective airfoil. As a result, a rib is provided that facilitates improved aerodynamic performance of a blade, while providing aeromechanical stability to the blade, in a cost effective and reliable manner.

Exemplary embodiments of blade assemblies are described above in detail. The blade assemblies are not limited to the specific embodiments described herein, but rather, components of each assembly may be utilized independently and separately from other components described herein. Each rotor blade component can also be used in combination with other rotor blade components.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine, said method comprising:

forming an airfoil including a first side wall and a second side wall that each extend in radial span between an airfoil root and an airfoil tip, and wherein the first and second side walls are connected at a leading edge and at a trailing edge; and forming a rib that extends outwardly from at least one of the airfoil first side wall and the airfoil second side wall, and extends in a chordwise direction from the airfoil leading edge to the airfoil trailing edge, such that a natural frequency of chordwise vibration of the airfoil is increased to a frequency that is not excited by any excitation frequencies during normal engine operations.

2. A method in accordance with claim 1 wherein forming a rib that extends outwardly from at least one of the airfoil first side wall and the airfoil second side wall comprises:

forming a first rib that extends outwardly from the airfoil first side wall and is positioned a first radial distance from the airfoil tip; and forming a second rib that extends outwardly from the airfoil second side wall and is positioned a second radial distance from the airfoil tip.

3. A method in accordance with claim 1 wherein energy input to the airfoil during engine operations is calculated by the product of the exciting force and the displacement of the airfoil at the point of application of the exciting force, forming a rib that extends outwardly from at least one of the airfoil first side wall and the airfoil second side wall comprises forming the rib that extends outwardly from the airfoil to facilitate reducing an amount of displacement of the airfoil.

4. A method in accordance with claim 1 wherein forming a rib that extends outwardly from at least one of the airfoil first side wall and the airfoil second side wall comprises forming the rib to facilitate reducing airfoil tip vibration amplitude during engine operation.

5. An airfoil for a gas turbine engine, said airfoil comprising:

a leading edge;

a trailing edge;

a tip;

a first side wall extending in radial span between an airfoil root and said tip, said first side wall defining a first side of said airfoil;

a second side wall connected to said first side wall at said leading edge and said trailing edge, said second side wall extending in radial span between the airfoil root and said tip, said second side wall defining a second side of said airfoil; and a rib extending outwardly from at least one of said first side wall and said second side wall, said rib extending from said leading edge to said trailing edge, such that a natural frequency of chordwise vibration of said airfoil is increased to a frequency that is not excited by any excitation frequencies during normal engine operations.

6. An airfoil in accordance with claim 5 wherein at least one of said airfoil first side wall and said second side wall is concave, said remaining side wall is convex, said rib extends from said airfoil leading edge chordwise to said airfoil trailing edge.

7. An airfoil in accordance with claim 5 wherein energy input to said airfoil during engine operations is calculated by the product of the exciting force and the displacement of said airfoil at the point of application of the exciting force, said rib configured to facilitate reducing an amount of displacement of said airfoil.

8. An airfoil in accordance with claim 5 wherein said rib is configured to facilitate reducing airfoil tip vibration amplitude during engine operation.

9. An airfoil in accordance with claim 5 wherein said rib is a radial distance from said airfoil tip.

10. An airfoil in accordance with claim 5 wherein a first rib extends outwardly from said first side wall, and a second rib extends outwardly from said second side wall.

11. A gas turbine engine comprising a plurality of rotor blades, each said rotor blade comprising an airfoil comprising a leading edge, a trailing edge, a first side wall, a second side wall, and at least one rib, said airfoil first and second side walls connected axially at said leading and trailing edges, said first and second side walls extending radially from a blade root to an airfoil tip, said rib extending outwardly from at least one of said airfoil first side wall and said airfoil second side wall, said rib further extending substantially chordwise from said leading edge to said trailing edge, such that a such that a natural frequency of chordwise vibration of said airfoil is increased to a frequency that is not excited by any excitation frequencies during normal engine operations.

12. A gas turbine engine in accordance with claim 11 wherein said at least one of said rotor blade airfoil first side wall and said second side wall is concave, at least one of said airfoil first side wall and said second side wall is convex.

13. A gas turbine engine in accordance with claim 12 wherein energy input to said airfoil during engine operations is calculated by the product of the amount of exciting force exerted upon said airfoil and an amount of displacement of said airfoil at the point of application of, and in response to, the exciting force, said rib configured to facilitate reducing an amount of displacement of said airfoil.

14. A gas turbine engine in accordance with claim 12 wherein said airfoil rib is configured to facilitate reducing airfoil tip vibration amplitude during engine operation.

15. A gas turbine engine in accordance with claim 12 wherein said airfoil rib is a radial distance from said airfoil tip.

16. A gas turbine engine in accordance with claim 12 wherein said at least one rib comprises a first rib extending outwardly from said airfoil first side wall, and a second rib extending outwardly from said airfoil second side wall.

17. A gas turbine engine in accordance with claim 16 wherein said first rib is a first radial distance from said airfoil tip, said second rib is a second radial distance from said airfoil tip, said first radial distance approximately equal said second radial distance.

* * * * *

UNITED STATES PATENT AND TRADEMARK OFFICE

CERTIFICATE OF CORRECTION

PATENT NO. : 6,779,979 B1
DATED : August 24, 2004
INVENTOR(S) : Wadia et al.

It is certified that error appears in the above-identified patent and that said Letters Patent is hereby corrected as shown below:

Column 6,
Line 30, delete "such that a such that a natural" and insert therefor
-- such that a natural --.

Signed and Sealed this

Twenty-third Day of August, 2005

JON W. DUDAS
*Director of the United States Patent and Trademark Office*